US007815131B2

(12) United States Patent
Dick et al.

(10) Patent No.: US 7,815,131 B2
(45) Date of Patent: Oct. 19, 2010

(54) INJECTOR WITH IMPROVED CONNECTION GEOMETRY

(75) Inventors: Jürgen Dick, Laaber (DE); Willibald Schürz, Pielenhofen (DE); Martin Simmet, Bad Abbach (DE); Marcus Unruh, Zeitlarn (DE)

(73) Assignee: Continental Automotive GmbH, Hannover (DE)

( * ) Notice: Subject to any disclaimer, the term of this patent is extended or adjusted under 35 U.S.C. 154(b) by 754 days.

(21) Appl. No.: 10/853,990

(22) Filed: May 25, 2004

(65) Prior Publication Data

US 2004/0231637 A1 Nov. 25, 2004

Related U.S. Application Data

(63) Continuation of application No. PCT/DE03/00507, filed on Feb. 18, 2003.

(30) Foreign Application Priority Data

Feb. 19, 2002 (DE) ..... 102 06 908

(51) Int. Cl.
*B05B 1/30* (2006.01)

(52) U.S. Cl. ..... 239/533.1; 239/585.1

(58) Field of Classification Search ..... 239/533.1, 239/533.2, 533.3, 585.1, 585.2; 123/496, 123/446

See application file for complete search history.

(56) References Cited

U.S. PATENT DOCUMENTS

| | | | | | |
|---|---|---|---|---|---|
| 4,046,112 | A | * | 9/1977 | Deckard | 239/96 |
| 4,603,671 | A | * | 8/1986 | Yoshinaga et al. | 123/467 |
| 4,628,881 | A | * | 12/1986 | Beck et al. | 123/447 |
| 5,823,445 | A | * | 10/1998 | Sofer | 239/585.1 |
| 5,878,720 | A | * | 3/1999 | Anderson et al. | 123/496 |
| 6,131,540 | A | | 10/2000 | Bronkal | 123/41.31 |
| 6,173,699 | B1 | * | 1/2001 | Kasen | 123/446 |
| 6,892,706 | B2 | | 5/2005 | Kienzler et al. | 123/468 |

FOREIGN PATENT DOCUMENTS

| | | | |
|---|---|---|---|
| DE | 19619523 | A1 | 11/1997 |
| DE | 197 17 459 | A1 | 11/1998 |
| DE | 19717459 | A1 | 11/1998 |
| DE | 199 40 387 | C1 | 2/2001 |
| DE | 10115322 | A1 | 10/2002 |
| EP | 1 118 765 | A2 | 12/2000 |
| GB | 2358107 | | 7/2001 |
| WO | WO 97/43542 | | 11/1997 |
| WO | WO 01/18382 | | 3/2001 |
| WO | WO 01/60089 | | 8/2001 |
| WO | WO 01/76164 | | 10/2001 |
| WO | WO 02/077438 | | 10/2002 |

* cited by examiner

*Primary Examiner*—Davis Hwu
(74) *Attorney, Agent, or Firm*—King & Spalding L.L.P.

(57) ABSTRACT

An injector, especially for an accumulator injection device, comprises an inlet connection (8), a leakage connection (3) and an electric connection (7). The leakage connection (3) and the electric connection (7) are embodied as a single-piece injection component (2), wherein the component is directly injection-moulded onto the injector (1).

15 Claims, 2 Drawing Sheets

INJECTOR WITH IMPROVED CONNECTION GEOMETRY

CROSS REFERENCE TO RELATED APPLICATION

This application is a continuation of copending International Application No. PCT/DE03/00507 filed Feb. 18, 2003 which designates the United States, and claims priority to German application no. 102 06 908.5 filed Feb. 19, 2002.

TECHNICAL FIELD OF THE INVENTION

The invention relates to an injector, in particular for an accumulator injection device with an improved connection geometry.

DESCRIPTION OF THE RELATED ART

There are various known forms of injectors for accumulator injection devices. Injectors of this type have a high-pressure connection for feeding in fuel under high pressure, an electrical connection plus a leakage connection for removing any leakage out of the injector. Here, the connection points are located at different positions on the injector, in particular on the injector head and on the main body of the injector.

DE 199 40 387 C1, for example, discloses a leakage connection for a fuel injector for which a connection stub is formed in one piece with an injector body. In this case, a stepped bore is provided in the connection stub so that it can be joined to a connection nipple, which engages with an insert in the stepped bore. Here, an elastic clip is used to make a joint between the connection nipple and the connection stub. In addition, a separate electrical connection is provided, and a separate high-pressure inlet connection for the fuel.

In addition, WO 01/18382 A1 discloses a common rail injector on which an electrical connection and a leakage return connection are located on the head end of the injector. For this purpose, a connection stub for the leakage connection is formed on the injector, this being surrounded by a cap-like sleeve. This cap-like sleeve also provides protection for the electrical connection terminals. In addition, the leakage connection is formed by a connector shell which is plugged together removably, by means of locking devices, over the connection stub and the sleeve body of the electrical terminal. As a result, this known solution comprises numerous individual parts, in order to provide the connection geometry required for the electrical connection and the leakage connection.

SUMMARY OF THE INVENTION

Starting from this point, it is the object of the present invention to provide a leakage connection or injector with a leakage connection, as applicable, which is simply constructed and can be supplied at low cost.

This object is achieved by an injector, in particular for an accumulator injection device, comprising an inlet connection, a leakage connection and an electrical connection, wherein the leakage connection and the electrical connection are formed as a one-piece molded component, which is molded directly onto the injector.

The molded component can be manufactured from plastic. The leakage connection can be arranged with an offset of 180° to the electrical connection. The one-piece molded component can be arranged on the head of the injector. The inlet connection can be arranged on the end face of the head of the injector. The one-piece molded component can be arranged around the inlet connection. A leakage return bore can be formed in the injector as a simple cylindrical borehole. A recess can be formed, running around the outer perimeter of the leakage connection, in order to attach a locking device. The leakage connection and the electrical connection can be each arranged at an angle of approximately 45° to a center line of the injector. The one-piece molded component may completely cover the end face of the head of the injector, like a cap.

The object can also be achieved by a leakage connection for attaching a leakage line to an injector, wherein the leakage connection and an electrical connection for the injector are formed as a one-piece molded component, where the one-piece molded component is molded directly onto the injector.

The leakage connection can be formed in the one-piece molded component in a direction which is offset by 180° to that of the electrical connection. The leakage connection and the electrical connection can be each arranged at an angle of approximately 45° to a center line of the injector. The leakage connection and the electrical connection can be completely manufactured in a single work step by means of injection molding of a plastic.

In the case of the solution in accordance with the invention, a leakage connection for the injector is integrated into a molded surround for the electrical connection. Hence, in accordance with the invention a one-piece component is provided, which is molded onto the injector, and incorporates the leakage connection and the electrical connection. This involves the one-part component being molded directly onto the injector, so that the number of components is kept to a minimum. Here, the injector is molded on in one operation, in which the electrical connection and the leakage connection are manufactured at the same time. As the one-part component is molded directly onto the injector, it is then impossible to remove it from the injector without damaging it. Thus, the leakage connection in accordance with the invention and the electrical connection can be manufactured particularly cost-effectively.

Since, according to the invention, the leakage connection is formed in one piece with the electrical connection, it is preferable that only one further leakage borehole, in the form of a simple cylindrical bore, is provided in the injector for feeding in the leakage. This makes it possible, in particular, to eliminate the expensive manufacture of a stepped borehole, used in the prior art, with its subsequent rework steps, such as deburring and hardening, required because the wall thickness gets progressively thinner towards the outside. In addition, there is also no need for additional connection stubs for the leakage borehole. Furthermore, a leakage nipple attachment will preferably be integrated into the one-part molded surround.

For this reason it is particularly preferable if the one-piece molded component is made of plastic.

Preferably, the leakage connection in the one-piece molded component will be arranged with an offset of 180° relative to the electrical connection. The axes of the electrical connection and of the leakage connection will then lie in a plane passing through a central axis of the injector, resulting in a relatively simple construction for the molding die.

In order to provide a particularly compact construction, the one-piece molded component with the two connections will preferably be arranged on the head of the injector. Here, the term 'head of the injector' is to be understood as that end of the injector which is furthest from the end from which fuel is sprayed into a combustion space in a combustion engine.

In accordance with a further preferred form of embodiment of the present invention, the inlet connection (high-pressure connection) of the injector is arranged on the end face of the head of the injector. The one-piece molded component will then preferably be molded around the inlet connection. The one-piece molded component will then have a type of capping function, with only a single through passage for the inlet connection, on the face of the end area.

Running round the outer perimeter of the molded-on leakage connection there will preferably be a recess, in particular a groove with a U-shaped cross-section. A locking device can engage in this groove, providing an interlock with a return line.

In accordance with a particularly preferred form of the present invention, the leakage connection and the electrical connection will be arranged at an angle of approximately 45° to a center line of the injector. This will enable the connection to be kept particularly compact.

According to a further preferred form of the present invention, the one-piece molded component will preferably enclose the entire head end of the injector, so as to maintain a complete covering over the injector head.

In addition, according to the invention a leakage connection is provided for attaching a leakage line to an injector, whereby the leakage connection and an electrical connection for the injector are formed in a one-piece component. This one-piece component is molded directly onto the injector. Hence, in accordance with the invention, the leakage connection is integrated into the molded surround of the electrical connection, so that it is simple and cheap to manufacture and has a minimum number of component parts. Doing so enables the connection lines to the leakage connection, which are necessary in the injector, to be particularly simply constructed and again provided very cheaply.

The present invention will be used in particular with fuel accumulator injection systems such as, for example, common-rail systems. The integration of the leakage connection and the electrical connection into one molded component, in accordance with the invention, enables a particularly compact construction to be provided which, especially in cramped engine compartments, gives installation space advantages.

BRIEF DESCRIPTION OF THE DRAWINGS

The invention is described below by reference to a preferred form of embodiment together with the drawing. The drawing shows.

DETAILED DESCRIPTION OF THE PREFERRED EMBODIMENTS

Figure 1:
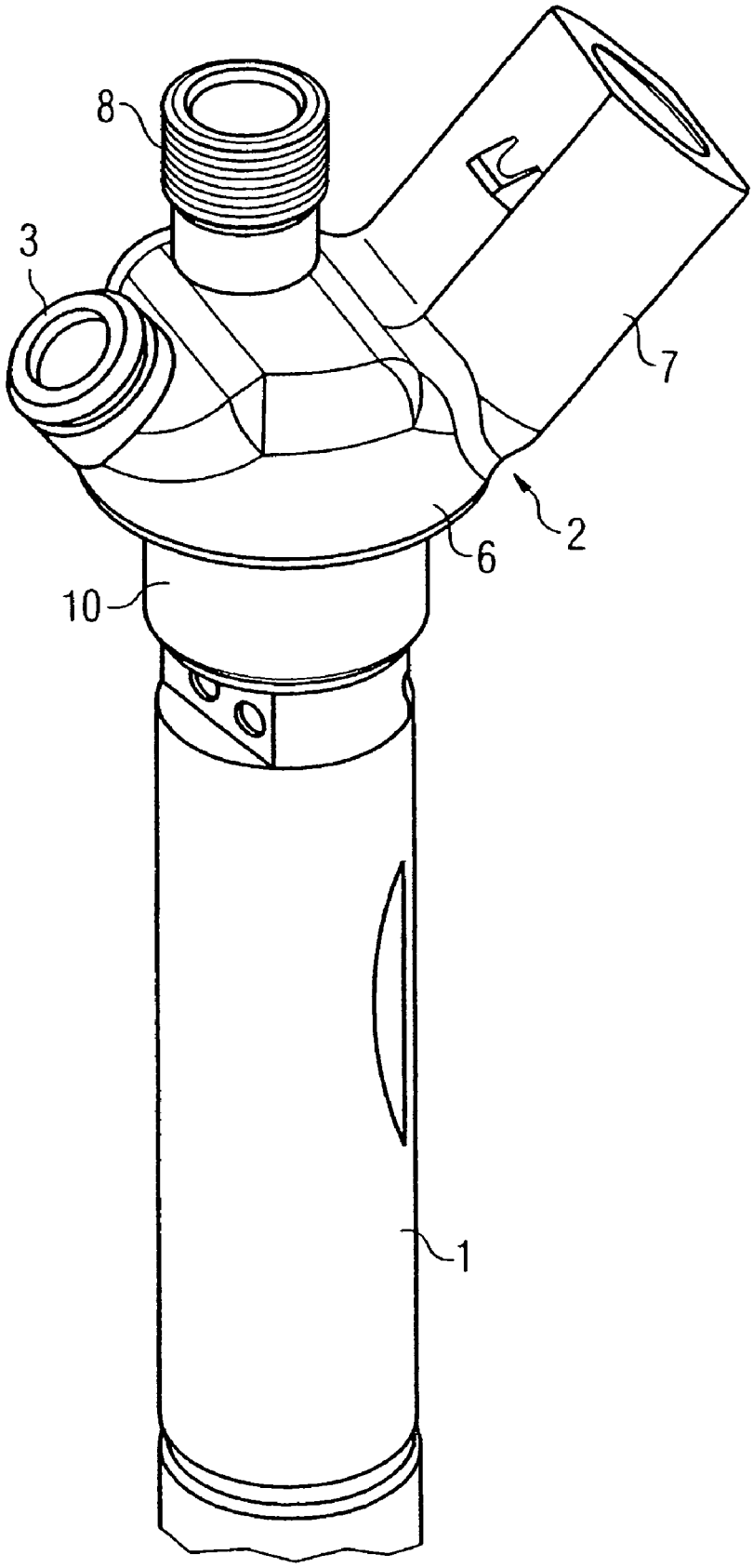
FIG. 1 a schematic perspective view of an injector in accordance with an exemplary embodiment of the present invention, FIG. 2 a side view of the injector shown in FIG. 1, and FIG. 3 a partially sectioned side view of the injector shown in FIG. 2.

An injector 1 in accordance with an exemplary embodiment is described below by reference to FIGS. 1 to 3. As shown in FIG. 1, a one-piece component 2 is affixed to the head 10 of the injector 1 by means of injection molding. The one-piece component 2 incorporates a leakage connection 3 plus an electrical connection 7. As can be seen from FIGS. 1 and 2 in particular, the molded component 2 is molded onto the head 10 of the injector 1 in the form of a cover. Here, the molded component 2 is molded around a fuel inlet connection 8 arranged on the end face of the head 10, so as to form a ring-shaped main body 6 of the molded component 2, from which the leakage connection 3 and the electrical connection 7 branch off.

Figure 3:
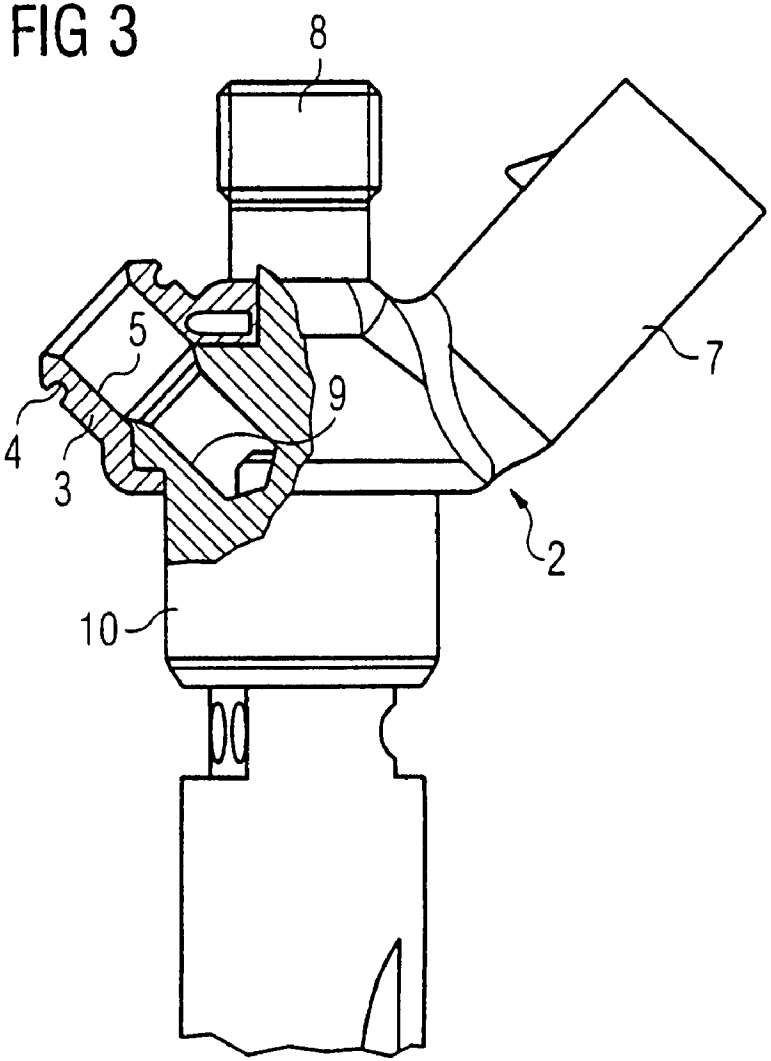
Figure 2:
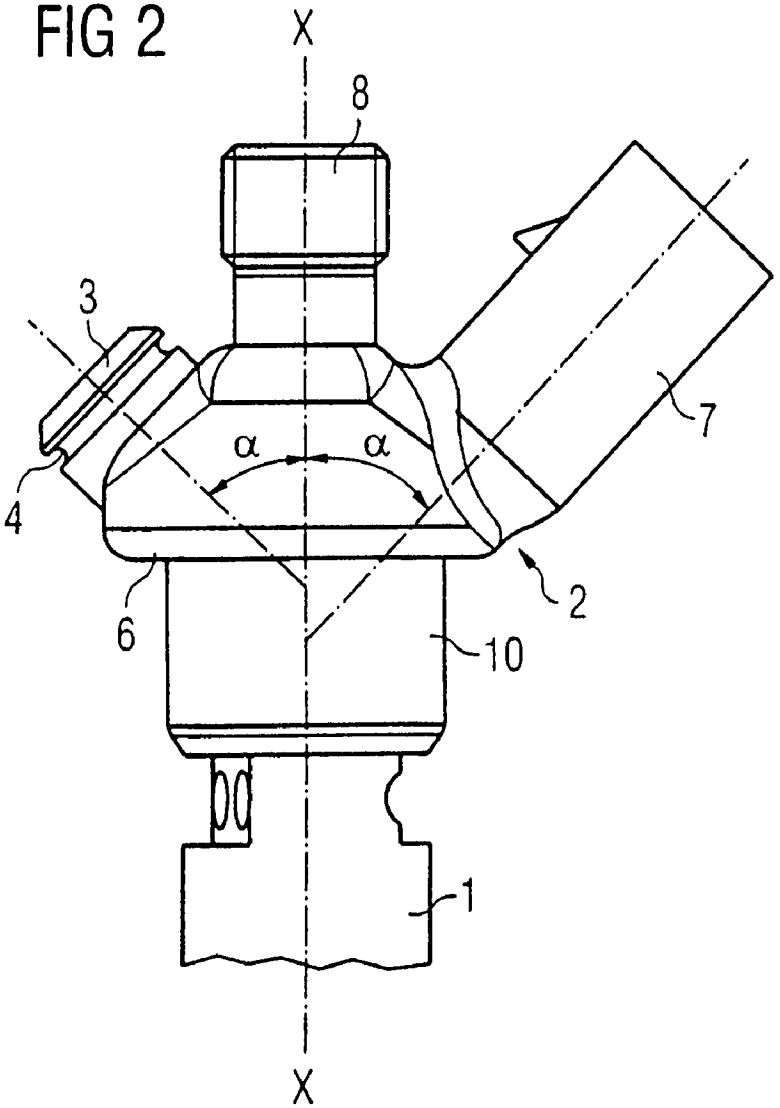

As can be seen in particular from FIGS. 2 and 3, the leakage connection 3 and the electrical connection 7 are arranged at an angle $\alpha$ of about 45° to a center line X-X of the injector. Furthermore, the leakage connection 3 is arranged with respect to the electrical connection 7 in such a way that their two center lines lie in the same plane. In other words, the leakage connection 3 is arranged to be offset by 180° relative to the electrical connection 7 (cf. FIG. 1).

Because, with the exemplary embodiment illustrated, the inlet connection 8, the electrical connection 7 and the leakage connection 3 are all arranged on the head 10 of the injector, a particularly compact and slim injector 1 is obtained. This means in particular that, because all the connections are arranged at its head end, the injector 1 can be built into various engines from different manufacturers, which offer different installation space. The injector in accordance with the invention is therefore universally usable, and it is not necessary to have available a special injector for each engine manufacturer.

Because the one-piece molded part 2 is molded directly onto the injector, it can then only be removed from the injector by destroying it. However, this direct molding-on does also prevent any unintended removal, for example due to vibrations or such causes.

As shown in FIG. 3, in particular, a leakage line 9 arranged in the injector 1 takes the form of a simple cylindrical bore, with a chamber at its end. Because, in accordance with the invention, the leakage connection is formed completely in the molded component, the prior art stepped bore in the injector head, which must be expensively manufactured and reworked, is superfluous. As the one-piece component 2 is a molded component it is possible, in particular, to form the inner recess 5 of the leakage connection 3 in a simple manner, e.g. even as a step-shape.

As shown in FIGS. 2 and 3, a groove 4 is formed running round the outer perimeter of the leakage connection 3, which is used to accept a locking element, by which a return line can be fixed.

Since the leakage connection 3 and the electrical connection 7 on the ring-shaped main body 6 are essentially arranged to lie opposite each other, this results in a particularly simple construction for the molding die. Thus, the two connections 3 and 7 can be formed in a single work step. In doing this, the electrical connection 7 can be formed in the familiar way as a plug connection, so that the subsequent assembly into the engine can also be carried out quickly and simply.

Thus the present invention concerns an injector, in particular for an accumulator injection device, with an inlet connection 8, a leakage connection 3 and an electrical connection 7. The leakage connection 3 and the electrical connection 7 are formed as a one-piece molded component 2, which is molded directly onto the injector 1.

The present invention is not restricted to the exemplary embodiment illustrated. Various derivatives and changes can be applied without going beyond the boundaries of the invention.

We claim:

1. An accumulator injection device, comprising:

a head component comprising an inlet connection extending from an end of the head component;

a cover component, comprising:

a leakage connection; and an electrical connection;

wherein the cover component comprising the leakage connection and the electrical connection is an integral component separate from the head component comprising the inlet connection, and wherein the cover component is affixed to the separate inlet connection to form an annular shape body coupled to the head component around the inlet connection, such that at least a portion of the inlet connection extends completely through and beyond the annular shape body of the separate cover component to provide an external connector for attachment to an inlet conduit distinct from the cover component, and such that the separate cover component is located between the head component and the portion of the inlet connection extending completely through and beyond the separate cover component; and wherein the leakage connection is spaced apart from the electrical connection on the annular shape body.

2. The injector in accordance with claim 1, wherein the leakage connection is arranged with an offset of 180° to the electrical connection.

3. The injector in accordance with claim 1, wherein the head component and the annular shape body are arranged on a head of the injection device.

4. The injector in accordance with claim 1, wherein the cover component is arranged around the inlet connection.

5. The injector in accordance with claim 1, wherein a leakage return bore is formed in the injector as a simple cylindrical borehole.

6. The injector in accordance with claim 1, wherein a recess is formed, running around the outer perimeter of the leakage connection, in order to attach a locking device.

7. The injector in accordance with claim 1, wherein the leakage connection and the electrical connection are each arranged at an angle of approximately 45° to a center line of the injector.

8. The injector in accordance with claim 1, wherein the inlet connection is arranged on the end face of a head of the injector and the cover component is arranged around the inlet connection.

9. The injector in accordance with claim 1, wherein a recess is formed, running around the outer perimeter of the leakage connection, in order to attach a locking device.

10. A leakage connection for attaching a leakage line to an injector, wherein the leakage connection and an electrical connection for the injector are formed on a cover component, and wherein the cover component comprising the leakage connection and the electrical connection is an integral component separate from a head component comprising an inlet connection, and wherein the cover component is coupled to the separate inlet connection to form an annular shape body coupled to the injector, such that at least a portion of the inlet connection extends completely through and beyond the annular shape body of the separate cover component to provide an external connector for attachment to an inlet conduit distinct from the cover component, and such that the separate cover component is located between the head component and the portion of the inlet connection extending completely through and beyond the separate cover component.

11. The leakage connection in accordance with claim 10, wherein the leakage connection is formed in a one-piece molded component in a direction which is offset by 180° to that of the electrical connection.

12. The leakage connection in accordance with claim 10, wherein the leakage connection and the electrical connection are each arranged at an angle of approximately 45° to a center line of the injector.

13. An accumulator injection device, comprising:

an injector comprising an injector head, and a fuel inlet connection arranged on an end face of the injector head, and a leakage line in the form of a bore hole in the injector head;

a one-piece component comprising a leakage connection and an electrical connection, wherein the fuel inlet connection and the one-piece component are separate components, wherein the one-piece component covers the injector head and is arranged on the end face of the injector head so as to form a ring-shaped main body around the fuel inlet connection of the injector so that at least a portion of the fuel inlet connection extends completely through and beyond the ring-shaped main body of the one-piece component to provide an external connector for attachment to an inlet conduit distinct from the cover component, and so that the leakage connection communicates with the leakage line in the injector, wherein the leakage connection and the electrical connection branch off from the main body of the one-piece component in directions which are offset by about 180° to each other and at about an angle of approximately 45° to a center line of the injector, wherein the one-piece component comprises plastic and is affixed by means of injection molding to the injector head, and wherein the leakage connection comprises a recess that runs around the outer perimeter of the leakage connection, whereby a locking device may be attached to the leakage connection.

14. The injector in accordance with claim 13, wherein the leakage connection comprises a leakage return bore formed as a simple cylindrical borehole.

15. The injector in accordance with claim 13, wherein the leakage connection comprises a leakage return bore is formed in the injector as a step-shape.

* * * * *